United States Patent [19]

Lingenfelter

[11] 4,192,019

[45] Mar. 11, 1980

[54] MINI-SOCK

[75] Inventor: Ralph E. Lingenfelter, Friendsville, Tenn.

[73] Assignee: Holston Manufacturing Company, Knoxville, Tenn.

[21] Appl. No.: 900,989

[22] Filed: Apr. 28, 1978

[51] Int. Cl.[2] ..... A41B 11/00

[52] U.S. Cl. ..... 2/239

[58] Field of Search ..... 2/239, 240, 61; 36/10; 66/171

[56] References Cited

U.S. PATENT DOCUMENTS

| | | | |
|---|---|---|---|
| 3,130,566 | 4/1964 | Chesebro | 2/239 X |
| 3,146,468 | 9/1964 | McDonald | 2/239 |

*Primary Examiner*—H. Hampton Hunter

*Attorney, Agent, or Firm*—Luedeka & Hodges

[57] ABSTRACT

An improvement in a mini-sock comprising an abbreviated ankle portion defining a flap designed to overhang a shoe in the heel portion thereof.

5 Claims, 8 Drawing Figures

MINI-SOCK

This invention relates to mini-socks.

There has been marketed heretofore a mini-sock, especially designed for wear by women, wherein the sock comprises a foot portion having a profile substantially identical to the profile of a woman's shoe, such as a low cut tennis shoe. The socks commonly have been worn by women to avoid the chafing effect of the shoe on the foot while still presenting the appearance of no sock being worn. One of the problems with this type sock, sometimes termed a "footlet", has been the tendency of the sock to recede into the shoe in the course of walking, running, etc. To prevent such movement of the sock into the show, it has been proposed heretofore to secure a bulbous mass to the sock at the approximate rear midpoint of the sock, i.e. the sock heel, at a location adjacent to its top. This bulbous mass is intended to hang outside the shoe and prevent the sock from receding into the shoe. The fastening of this bulbous mass has been less than adequate in some instances so that during vigorous foot activity, such mass is lost so that the sock no longer is retained in position. Further, these bulbous masses have been less effective than is desirable.

It is an object of the present invention to provide an improved mini-sock. It is another object of the invention to provide a mini-sock which has improved resistance to recession of the sock into the shoe in the course of walking, running, etc. Other objects and advantages of the invention will be recognized from the following description, including the claims and the drawings, in which:

In accordance with the objects of the present invention, a mini-sock comprising a body section adapted to overlie the foot of a wearer and including a closed toe section, a closed heel section, and means defining an opening for receiving the foot of the wearer adjacent the heel section of the sock is provided with an abbreviated ankle portion, such ankle portion having removed therefrom a segment of the sock so that the remaining ankle portion defines a flap portion substantially encircling the opening in the sock within which the foot is received. In the preferred embodiment, this flap is continuous and extends from the approximate location of the instep of the wearer's foot and rearwardly therefrom, the flap increasing in overlap from a minimum overlap at the instep to a maximum overlap at the heel such that the dimension of the overall flap is sufficient to permit the flap to be backfolded over the heel section of the sock by a distance that causes the flap to overlie at least a major portion of a shoe upper in the heel portion thereof.

Figure 5:
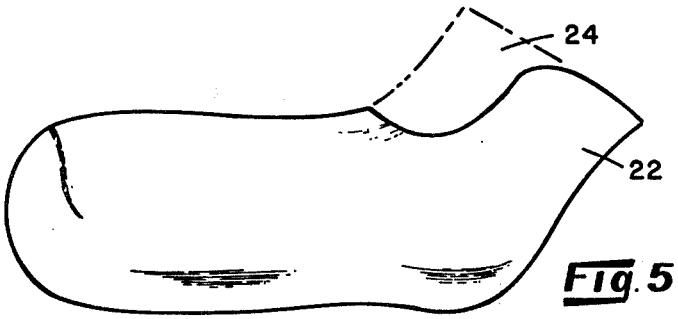
FIG. 5 is a representation of the present mini-sock at an intermediate stage of production.

Referring to the Figures, the depicted sock 10 includes a body portion 12, comprising a closed toe section 14, a closed heel section 16 (See FIG. 5), and means defining an opening 18 for receiving the foot 20 of a wearer. The sock further includes an ankle portion 22 (FIG. 5) which during one stage of its manufacture has removed therefrom a segment 24 (indicated in dotted lines in FIG. 5), so that the remaining ankle portion 22 defines a flap 26 of sufficient dimensions to be backfolded over the heel section 16 of the sock. When so backfolded, the juncture between the flap and the heel section defines the perimetral dimension of the opening 18 for receiving the wearer's foot.

Figure 1:
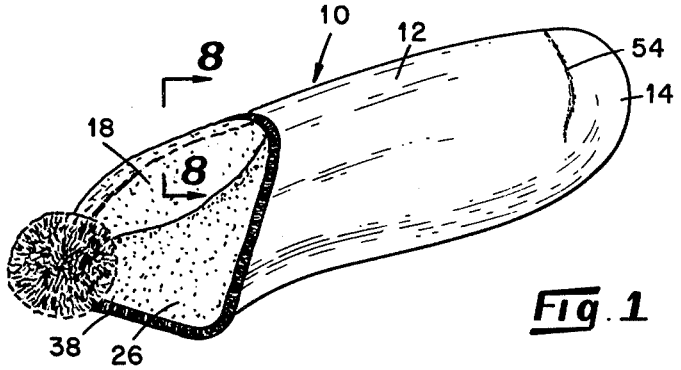
FIG. 1 is a representation of the present mini-sock.
Figure 2:
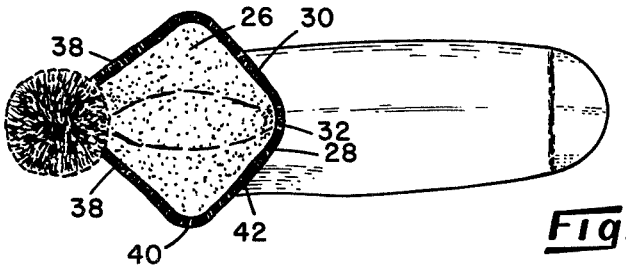
FIG. 2 is a top view of the present mini-sock.
Figure 3:
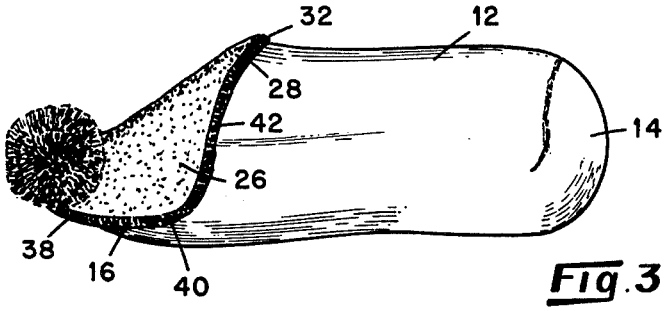
FIG. 3 is a right hand elevational side view of the present mini-sock.
Figure 4:
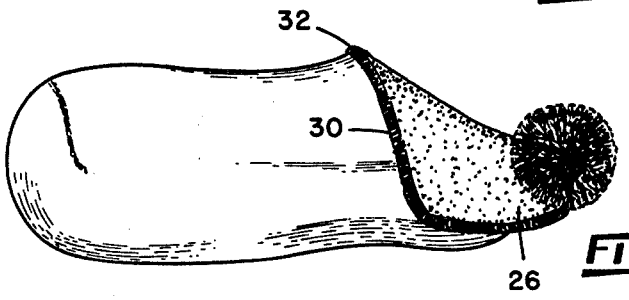
FIG. 4 is a left-hand side elevational view of the present mini-sock.

As shown in the drawings, the flap 26 of the present sock is formed by cutting away a generally triangular portion 24 from a preformed sock (See FIG. 5), and backfolding the remaining ankle portion 22 downwardly over the heel section of the sock. The depicted flap in its preferred embodiment, includes a distal perimetral edge 28, including a section so extending from the approximate location of the wearer's instep 32, downwardly and rearwardly along one side, for example, the left-hand side, (See FIG. 4) of the sock to a location adjacent to but spaced above the sole 34 of a shoe 36 (See FIG. 7) positioned on the foot 20 of a person. From this location, the perimetral edge 28 extends rearwardly and forms a further section 38 which wraps the most rearward heel portion 16 of the sock to extend to the opposite side (for example the right-hand side of the sock). The perimetral edge section 38 further extends from the most rearward portion of the sock generally forwardly along such opposite side of the sock and in a direction generally parallel to the sole 34 of the shoe, to a location 40 where the perimetral edge transists into a section 42 which extends generally upwardly and forwardly to a location of the instep 32 of the wearer, thereby forming a continuous line.

In the preferred embodiments, the distal perimetral edge of the flap is bound by a stitch of the type which permits expansion and contraction of the perimetral dimension of the edge. In one embodiment, this characteristic of the edge is provided by stitching the edge 28 with a stitch of the overedge type. In forming this stitch, preferably an elastic thread is employed. One suitable machine for forming a overedge stitch is a Merrow, Model No. M3Q3, manufactured by Merrow Machine Company.

Figure 6:
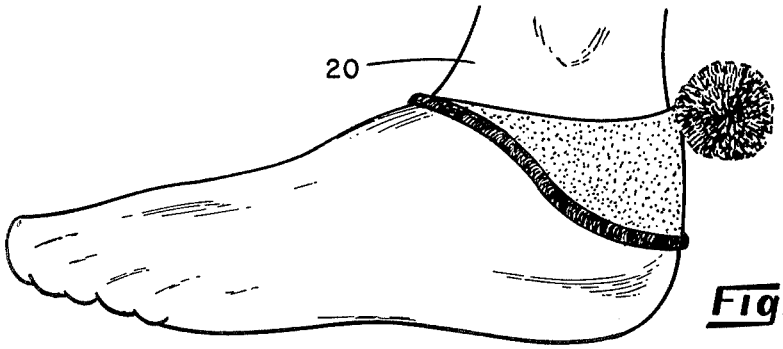
FIG. 6 is a representation of the present mini-sock on the foot of a wearer.
Figure 7:
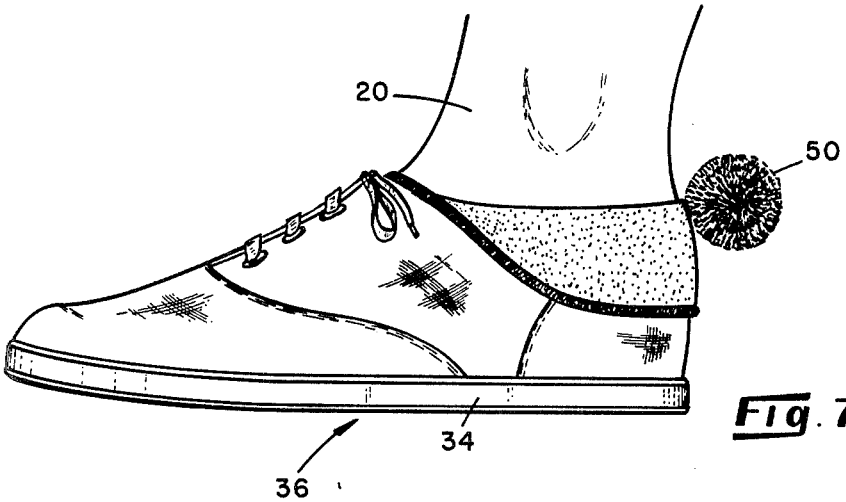
FIG. 7 is a representation of the present mini-sock as it appears when a shoe is worn therein.
Figure 8:
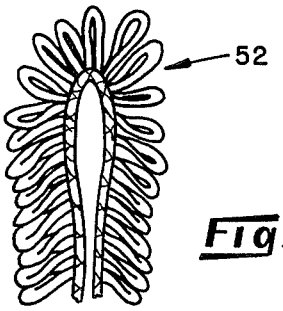
FIG. 8 is a fragmentary sectional view taken generally along the line 8—8 of FIG. 1.

It is noted that the aforedescribed configuration of the distal perimetral edge 28 of the flap results in an expansion of the perimetral dimension of the edge 28 when the sock is in position on a wearer's foot. Referring specifically to FIGS. 6 and 7, it is noted that when the sock is in position on the foot in a shoe with the flap overlying the heel portion of the shoe, the edge 28 is stretched substantially. Accordingly, when the flap is positioned in its overhanging relationship with the shoe upper, there are expansion forces applied to the perimetral edge of the flap such that the flap remains in snug overlying relationship with the shoe and is prevented from receding into the shoe in the course of walking, running, etc. Retention of the flap in this preferred position of overlying the shoe upper is further enhanced by the elastic nature of the stitching along the perimetral edge 28 which tends to retain the perimetral edge of the flap in frictional engagement with the outer surface of the shoe upper.

As desired, a decorative bulbous mass 50 may be attached to the flap in a manner well known in the art.

In the preferred embodiment, the present sock is formed by a two-sided material, one side being of the smooth nature with the opposite side being a terrycloth type surface. In this preferred embodiment, the terrycloth side of the material is disposed inwardly of the sock such that when the flap 26 is backfolded upon the heel portion, the flap displays the terrycloth side thereof. In this manner, there is developed a contrast between the physical appearance of body portion 12 of the sock and the flap 26, thereby accentuating the flap and enhancing its aesthetic appearance. Further, the bulky nature of the terrycloth surface provides a relatively soft lining for edge 52 for the opening 18 when and a shoe is thereafter positioned over the sock and on the wearer's foot and the flap is folded down over the rear portion of the shoe upper. In the course of this backfolding operation, the perimetral dimension of the edge 28 of the flap is stretched so that the flap engages the shoe upper in snug frictional engagement such that the sock does not recede into the shoe but rather remains in the desired position with the flap overlying the shoe upper during the course of walking, running, etc.

While a preferred embodiment has been shown and described, it will be understood that there is no intent to limit the invention by such disclosure, but rather, it is intended to cover all modification and alternate constructions falling within the spirit and scope of the invention as defined in the appended claims.

What is claimed is:

1. In a sock having a body section, a closed toe section, a closed heel section, and means defining an opening for receiving the foot of a wearer, said sock covering substantially the entire foot of a wearer, the improvement comprising an ankle portion having removed therefrom a segment of said sock extending from the approximate location of the wearer's instep in a direction toward said defined opening, said ankle portion defining a continuous flap circumscribing at least a major portion of said defined opening and, when disposed on a wearer's foot, being backfolded over said heel section by a distance sufficient to cause said flap to overlie at least a major portion of said heel, said flap including a distal perimetral edge which, when the sock is in position on the foot of a wearer and a shoe is also in position on the foot of the wearer with the sock being disposed between said foot and said shoe, lies in a continuous line extending from the approximate location of the wearer's instep in a downwardly and rearwardly direction generally parallel with and adjacent to the sole of said shoe, thence in a direction wrapping the most rearward portion of the heel of said shoe to a location on the opposite side of the shoe, thence in a direction on said opposite side of said shoe forwardly of said shoe and generally parallel with and adjacent to the sole of said shoe, thence in an upwardly and forwardly direction of the aforesaid approximate location of the wearer's instep.

2. The improvement of claim 1, wherein said distal perimetral edge is bound along its length with a stitch which provides for expansion and contraction of the perimetral dimension of said edge.

3. The improvement of claim 2 wherein said stitch is of the overedge type.

4. The improvement of claim 1 wherein said sock comprises a two-sided fabric, one of which sides is of a relatively smooth texture and the opposite one of which is relatively bulky texture, said last mentioned texture being exposed outwardly in said flap portion of said sock.

5. The improvement of claim 1 wherein said sock is free of stitching in the region of the fold that is formed when said flap is turned back over said heel.

* * * * *